US005228601A

United States Patent [19]

Podesta

[11] Patent Number: 5,228,601

[45] Date of Patent: Jul. 20, 1993

[54] LIQUID DISPENSER INCLUDING AN ELASTIC MEMBER WITH SLITS

[76] Inventor: Sally Podesta, 1151 Rutledge Way, Stockton, Calif. 95207

[21] Appl. No.: 847,180

[22] Filed: Mar. 6, 1992

[51] Int. Cl.[5] ..... B67D 5/06

[52] U.S. Cl. ..... 222/181

[58] Field of Search ..... 222/1, 105, 180, 181, 222/183, 185, 325

[56] References Cited

U.S. PATENT DOCUMENTS

| | | | |
|---|---|---|---|
| 1,480,405 | 1/1924 | Long et al. | 222/181 |
| 2,709,540 | 5/1955 | Kenney | 222/183 X |
| 3,217,939 | 11/1965 | Murray | 222/181 X |
| 3,252,633 | 5/1966 | Clarke | 222/185 X |
| 3,288,332 | 11/1966 | Etter et al. | 222/181 X |
| 3,540,631 | 11/1970 | Schmidt | 222/181 |
| 4,036,406 | 7/1977 | Jespersen et al. | 222/181 |
| 4,288,007 | 9/1981 | Rogers et al. | 222/181 X |
| 4,326,648 | 4/1982 | Kieber | 222/181 X |
| 4,972,978 | 11/1990 | DeLuca | 222/181 X |
| 5,118,009 | 6/1992 | Novitsky | 222/325 X |

FOREIGN PATENT DOCUMENTS

| | | | |
|---|---|---|---|
| 621966 | 6/1961. | Canada | 222/181 |
| 3715912 | 6/1988 | Fed. Rep. of Germany | 222/181 |
| 800544 | 8/1958 | United Kingdom | 222/181 |
| 950972 | 3/1964 | United Kingdom | 222/181 |

*Primary Examiner*—Kevin P. Shaver

*Attorney, Agent, or Firm*—Majestic, Parsons, Siebert & Hsue

[57] ABSTRACT

A dispensing apparatus using a sliding top member to help stabilize the bottle in the upside-down position. The apparatus has a bottom member with an elastic member defining a depression with a second hole and slits creating flaps. Beneath the elastic member is a well to hold the liquid and a dispensing mechanism at the bottom of this well.

7 Claims, 3 Drawing Sheets

FIG._4.
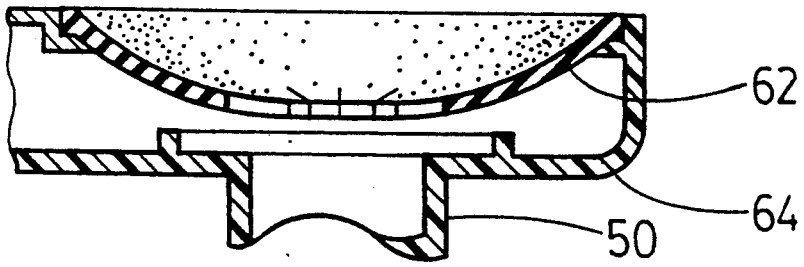
FIG._5.
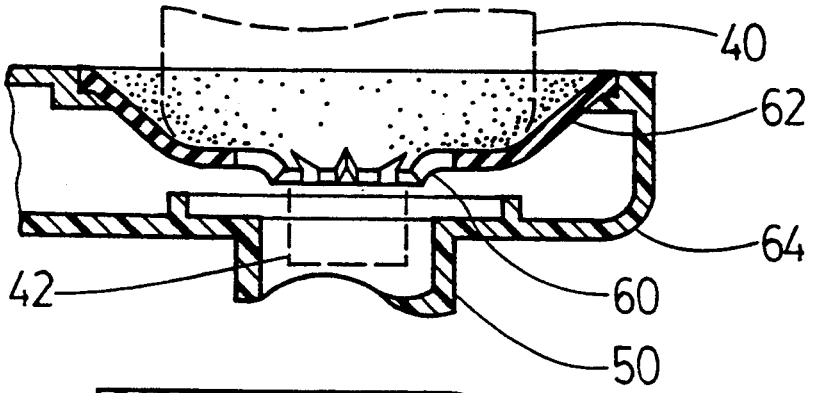
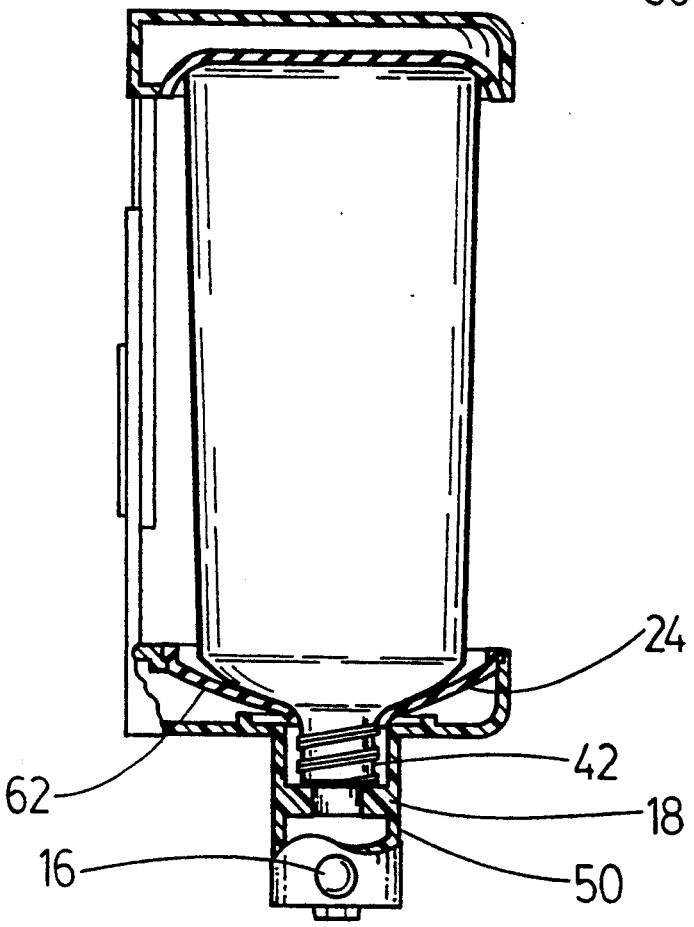
FIG._6.

LIQUID DISPENSER INCLUDING AN ELASTIC MEMBER WITH SLITS

BACKGROUND OF THE INVENTION

This invention relates to a system for dispensing a household or bath liquid from its container, in which the container is placed in an upside-down position in a dispensing apparatus. Household and bath liquids come in many different sizes and shapes of bottles. In many instances, it would be more convenient to dispense the liquid from a dispensing apparatus than to open and close these bottles for every use.

U.S. Pat. No. 3,042,267 and U.S. Pat. No. 2,117,791 disclose liquid dispensing apparatus that hold a bottle in position with a clamp connected to the neck of the bottle. While these two apparatus can hold the bottle containing a liquid in an upside-down position, they can not accept different size necks.

U.S. Pat. No. 998,389 discloses a liquid dispensing apparatus in which the neck of a bottle contacts a hopper lined with an elastic material. The hopper is concave shaped for accepting different sized necks. A slidable rod and arm assembly is connected to a convex shaped head which holds the bottle in place in the upside-down position.

It is therefore an object of the present invention to provide a liquid dispensing device that can accept different sized and shaped bottles, and that can be easily used by a consumer for dispensing a liquid.

A further object of the invention is to have a sliding assembly to hold the bottle in its upside-down position, which can hold up the bottle in a stable position without the sliding assembly being locked into a fixed position.

SUMMARY OF THE INVENTION

In accordance with the principles of the present invention, the above and other objectives are realized by using an apparatus for dispensing a liquid contained in a bottle. The apparatus has a bottom member including a base that supports the bottle in an upside-down position, the base defining therein a first hole for accommodating the neck of the bottle. Additionally, the base has an elastic member within the base, the elastic member defining a depression, the elastic member having a second hole and one or more slits in the member at the second hole, the second hole overlapping at least a portion of the first hole to accommodate the neck of the bottle, the slits permitting necks of different sizes and shapes to pass through the second hole. In the bottom member beneath the base is a well for receiving the neck of the bottle and for holding liquid that escapes from the neck of the bottle placed in an upside-down position. The bottom member also has a dispensing means for dispensing the liquid from the well. Connected to the bottom member is the top member.

Additionally, the above and other objectives are realized by using a method of dispensing a household or bath liquid in a bottle using an apparatus for dispensing a liquid contained in a bottle. The apparatus comprises a bottom member including: (a) a base that supports the bottle in an upside-down position, the base defining a first hole for accommodating the neck of the bottle; (b) a well beneath the base for receiving the neck of the bottle and for holding liquid that escapes from the neck of the bottle placed in an upside-down position; and (c) dispensing means for dispensing the liquid from the well; the apparatus also including a top member slidably connected to the bottom member. The method comprises removing a cap from the bottle; sliding up the top member relative to the bottom member; flipping the bottle upside-down; inserting the neck of the bottle through the first hole into the well until the bottle is supported by the bottom member; lowering the top member until it contacts the bottom of the bottle and holds it in place; and dispensing the household or bath liquid using the dispensing means in the bottom member.

BRIEF DESCRIPTION OF THE DRAWINGS

The above and other features and aspects of the present invention will become more apparent upon reading the following detailed description in conjunction with the accompanying drawings, in which:

FIG. 1 is a side elevational view of a bottle with its cap on;

FIG. 4 is a partial vertical cross-sectional view of the bottom member of the dispensing apparatus showing the slits in the elastic material and part of the well and base;

FIG. 5 is a partial vertical cross-sectional view showing the bottom member of the dispensing apparatus with the slits pushed down by the neck of a bottle placed therein and showing part of the well and base;

FIG. 6 is a vertical cross-sectional view of the dispensing apparatus showing the bottle in place;

DETAILED DESCRIPTION OF THE PREFERRED EMBODIMENT

Figure 7:
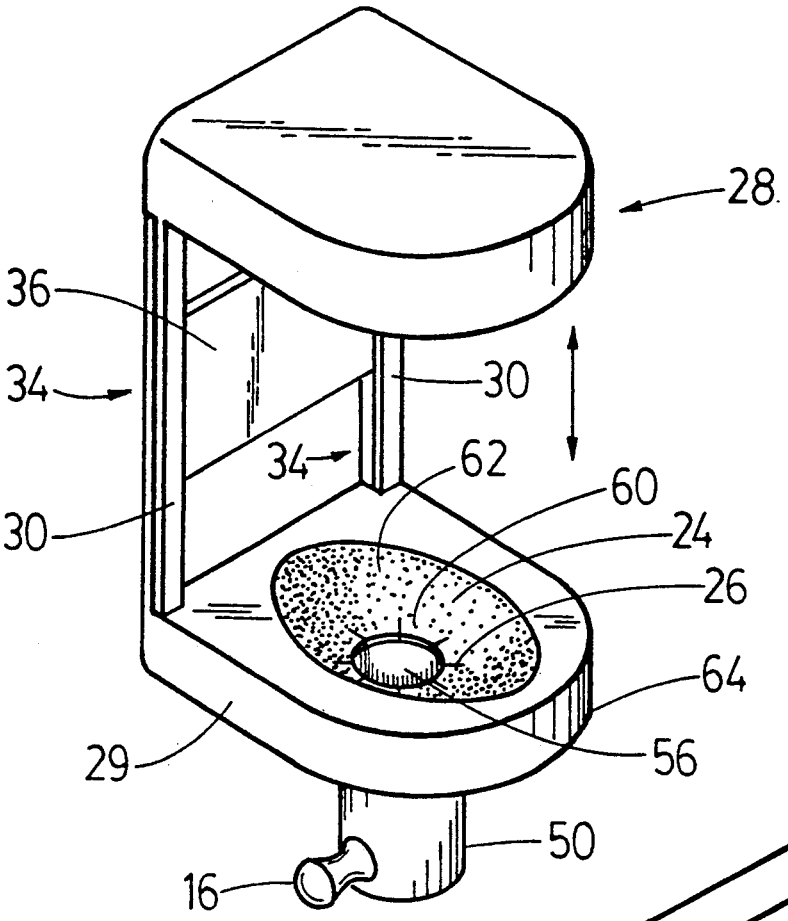
FIG. 7 is a perspective view of the dispensing apparatus.

FIG. 7 is a perspective view of the dispensing apparatus of the present invention used for dispensing a liquid in a bottle. The dispensing apparatus has a top member 28 and a bottom member 29. The top member is slidably attached to the bottom member so that it can be raised and lowered to fit different height bottles.

The top member has two arms 30 that are I-shaped in cross section. These two arms 30 engage two rods 34 that are C-shaped in cross section and these rods 34 are connected to the back of the bottom member 29. Each I-shaped arm 30 forms two grooves. The C-shaped rod engages both of the grooves in each I-shaped arm and loops around one side of the I-shaped arm to prevent the top member from making horizontal movements and allow the top member to slide up and down.

These two rods 34 are connected by stabilizing connector 36 used for stabilizing the dispensing apparatus. An attachment pad (not shown) connected to the back of the stabilizing connector 36 allows the dispensing apparatus to be attached to the wall.

The bottom member 29 also has a base 64 which supports an elastic member 62 that defines a concave depression 24 with which the base 64 is able to hold bottles with different size shoulders. In one embodiment of the present invention, the concave depression 24 is oval shaped to hold bottles with shoulders of different shapes. The elastic member 62 contains a hole 56 and slits 26 through which the neck of the bottle fits. The slits 26 define flaps 60 in the elastic member 62. One embodiment of the elastic member 62 shown in FIG. 7 has eight slits and eight flaps. The elastic member 62 with flaps 60 helps hold the bottle in its vertical position, and prevents the liquid from seeping out of the well of the dispensing apparatus.

Figure 8:
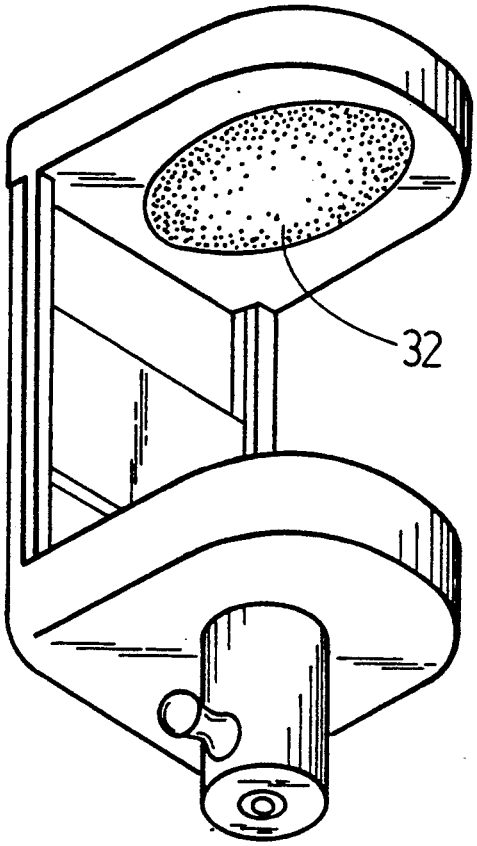
FIG. 8 is a perspective view of the dispensing apparatus showing the concave indentation at the top member.

FIG. 8 is a perspective view that shows the concave indentation 32 in the top member 28. When the bottle is in its upside-down position, the concave indentation 32 helps hold the bottle stable. Since the indentation is concave shaped, bottles with bottoms of different sizes and shapes can be held.

FIG. 4 is a partial vertical cross-sectional view of a section of the bottom member of the dispensing apparatus. Beneath the base 64 is a well 50 that accepts the liquid when the bottle is in its upside-down position. In FIG. 4, the normal positions of the flaps 60 of the elastic member 62 are shown, where no bottle is supported by the bottom member.

FIG. 5 is another partial vertical cross-sectional view. The neck of a bottle 40 is inserted into the hole 56 in the elastic member 62 placed in the elastic member 62 with slits 26. Since the hole 56 in the elastic member shown in FIG. 7 is smaller than the diameter of the necks of most bottles, the flaps 60 of the elastic member 62 bend to accommodate bottle necks of different shapes and sizes while maintaining contact with the neck 42 of the bottle to prevent liquid from escaping from the well 50 and to help stabilize the bottle in its upside-down position.

Because of the concave depression 24, the sliding top member 28 with the concave indentation 32, and the flaps 60 of the elastic member 62, the dispensing apparatus can dispense household or bath liquids from many types of bottles. For example, liquid in both the cylindrical-shaped bottles with circular shoulders and bottoms, and bottles with oval-shaped bottoms and shoulders can be dispensed using the present apparatus. The apparatus can hold different commercially-available shampoo bottles, conditioner bottles, lotion bottles, handsoap bottles, baby oil bottles and bottles containing other household or bath liquids, and dispense these liquids in an easy manner. Once the cap has been removed and the bottle installed, the user need not remove the cap from the bottle before each use, and need not put the cap back on after each use.

FIG. 6 is a vertical cross-sectional view of the dispensing apparatus with a bottle placed therein. In this figure, the neck 42 of the bottle rests upon a ledge 18 within the well 50 for holding up the bottle. In actual use, depending upon the length and size of the neck of the bottle, the neck of the bottle may or may not rest on the ledge. If the neck of the bottle does not rest on the ledge, the shoulder of the bottle will rest on the elastic member 62. The liquid flows into the well 50 in the bottom member, and can be dispensed from the bottom of the dispensing apparatus with the dispensing knob means 16.

Figure 1:
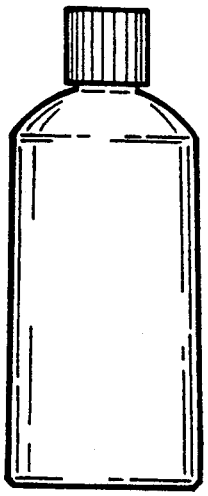
Figure 2:
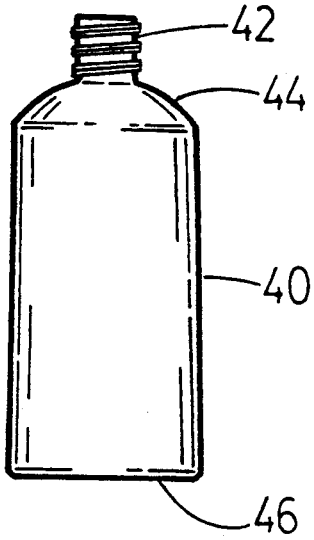
FIG. 2 is a side elevational view of a bottle with the cap removed.
Figure 3:
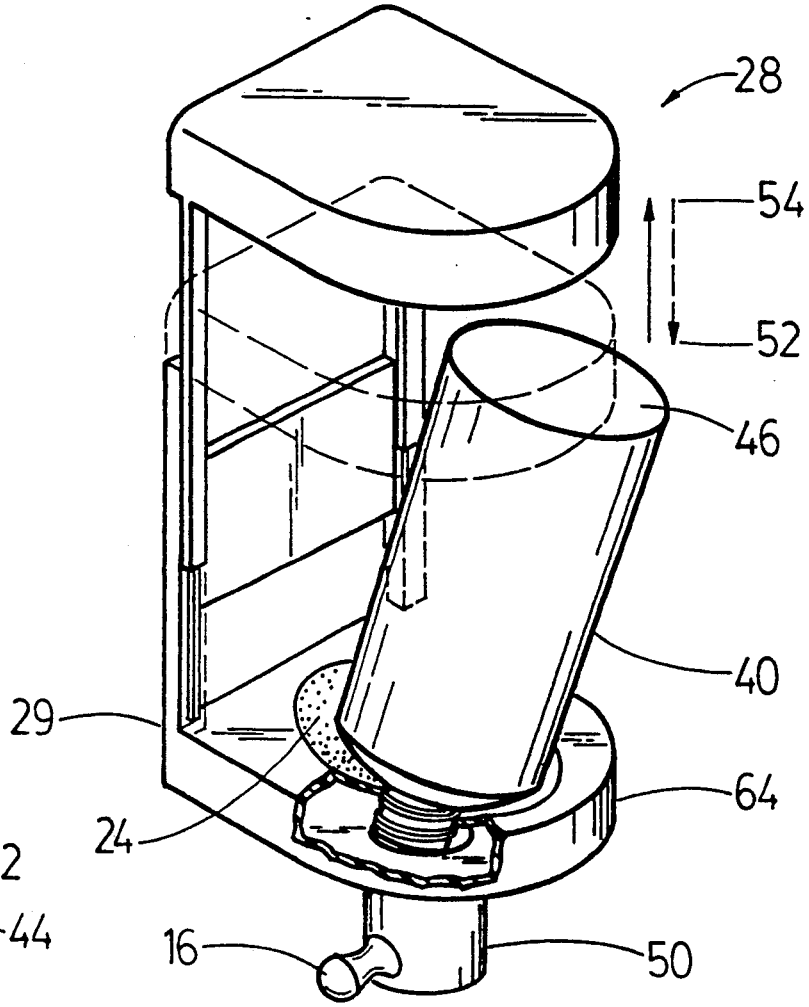
FIG. 3 is a cross-sectional perspective view of the dispensing apparatus and a bottle, showing the top member of the dispensing apparatus being lifted, the bottle with the top off being placed in the bottom member of the dispensing apparatus, and the top member of the dispensing apparatus being lowered upon the bottom of the bottle.

FIGS. 1 through 3 illustrate a method of placing the bottle into the dispensing apparatus. FIG. 1 is a side elevational view of a bottle with its cap on. The first step in the method is to remove the cap of the bottle as shown in the side elevational view of FIG. 2. FIG. 2 shows the neck 42, the shoulder 44 and bottom 46 of the bottle.

FIG. 3 is a cross-sectional perspective view of the dispensing apparatus and bottle. In FIG. 3, the top member 28 of the dispensing apparatus is first lifted from a low position 52 to a high position 54 so that the bottle 40 containing a liquid can be placed into the bottom member 29. The bottle 40 containing a liquid is flipped upside-down and placed through the slits 26 shown in FIG. 5 in the elastic material in the concave indentation at the bottom member 29. The neck of the bottle is placed through the slits quickly so that the liquid is not spilled. The bottle 40 containing a liquid is placed in an upside-down and upright position by tilting the bottle from the slanting position shown in FIG. 3, and the top member 28 is slid down onto the bottom 46 of the bottle to hold the bottle in place. Then the liquid which fills up the well 50 in the bottom member of the dispensing apparatus can be dispensed using the dispensing means 16.

Various details of the implementation and method are merely illustrative of the invention. It will be understood that various changes in such details may be within the scope of the invention, which is to be limited only by the appended claims.

What is claimed is:

1. An apparatus for dispensing a liquid contained in a bottle, said bottle having a shoulder and a neck through which liquid is to be dispensed, said apparatus comprising:

a bottom member including:

(a) a base that supports said bottle in an upside-down position, said base including a well for receiving the neck of the bottle and for holding liquid that escapes from the neck of the bottle placed in an upside-down position, said well defining therein a well opening for accommodating said neck of the bottle;

(b) an elastic member within said base above said well, said elastic member defining a depression, said elastic member having a hole and one or more slits in the member at the hole, said hole overlapping at least a portion of said well opening to accommodate said neck of the bottle, said one or more slits permitting necks of different sizes and shapes to pass through the hole; and (c) dispensing means for dispensing said liquid from said well; and a top member slidably connected to said bottom member.

2. Apparatus of claim 1, wherein said hole has a diameter and said well opening has a diameter and wherein the hole diameter is smaller than the well opening diameter and wherein when the neck of the bottle is inserted into the hole, and when the neck is larger in dimension than the hole the elastic member is in contact with the neck of said bottle to prevent liquid held in the well from escaping said well.

3. Apparatus of claim 2, wherein said one or more slits comprises at least two slits so that the elastic member defines at least two flaps surrounding the hole, and wherein when the neck of the bottle is inserted into the hole, the flaps will bend where necessary to accommodate bottle necks of different shapes and sizes while maintaining contact with the neck to prevent liquid from escaping from the well.

4. The apparatus of claim 3, wherein said at least two slits comprises eight slits in the elastic member at the hole so that the elastic member defines eight flaps surrounding the hole.

5. Apparatus of claim 1, wherein said top member defines a concave indentation facing the bottom member to contact the bottom of said bottle for stabilizing said bottle in its upside-down position.

6. Apparatus of claim 1, wherein said well defines a ledge for supporting said neck of said bottle.

7. Apparatus of claim 1, wherein said depression defined by said elastic member is oval in shape.

* * * * *